US005964906A

United States Patent [19]

Layrisse et al.

[11] Patent Number: 5,964,906

[45] Date of Patent: Oct. 12, 1999

[54] EMULSION WITH SOLID ADDITIVE IN HYDROCARBON PHASE AND PROCESS FOR PREPARING SAME

[75] Inventors: Ignacio A. Layrisse; Nilia C Romero; Gustavo A. Nunez, all of Caracus, Venezuela

[73] Assignee: Intevep, S.A., Caracas, Venezuela

[21] Appl. No.: 08/967,100

[22] Filed: Nov. 10, 1997

[51] Int. Cl.[6] ..... C10L 1/32

[52] U.S. Cl. ..... 44/302; 44/301

[58] Field of Search ..... 44/301, 302

[56] References Cited

U.S. PATENT DOCUMENTS 4,131,433 12/1978 Scott ..... 44/320
5,083,613 1/1992 Gregoli et al. ..... 166/275
5,322,617 6/1994 DeBruijn et al. ..... 208/108
5,593,889 1/1997 Valentine ..... 435/282

*Primary Examiner*—Ellen M. McAvoy
*Attorney, Agent, or Firm*—Bachman & Lapointe, P.C.

[57] ABSTRACT

A process for preparing a hydrocarbon in water emulsion includes the steps of: providing a hydrocarbon phase containing a contaminant selected from the group consisting of vanadium, sulfur, and mixtures thereof; mixing a solid additive with the hydrocarbon phase, the solid additive being selected from the group consisting of calcium compounds, magnesium compounds and mixtures thereof so as to provide a hydrocarbon suspension including the solid additive; and forming an emulsion from the hydrocarbon suspension and an aqueous phase including a surfactant so as to form a combustible hydrocarbon in water emulsion having the solid additive suspended in the hydrocarbon phase.

29 Claims, 3 Drawing Sheets

EMULSION WITH SOLID ADDITIVE IN HYDROCARBON PHASE AND PROCESS FOR PREPARING SAME

BACKGROUND OF THE INVENTION

The invention relates to a combustible hydrocarbon in water emulsion and process for preparing same and, more particularly, to an emulsion and process including a solid additive for counteracting vanadium and sulfide contaminants which may be present in the hydrocarbon, while maintaining stability of the emulsion during transportation and storage.

Hydrocarbon in water emulsions are useful in providing transportable liquid fuels from low gravity, viscous hydrocarbons which may typically have viscosity ranging from 10,000 to 200,000 cp and API gravities of less than 12. These emulsions greatly enhance the transportability of the viscous hydrocarbon, and are combustible as an excellent source of fuel.

Heavy or viscous hydrocarbon typically used to form such hydrocarbon in water emulsions generally includes contaminants such as vanadium, sulfur and the like which can cause undesirable corrosive conditions or produce undesirable end products upon combustion of the fuel.

A number of efforts have been made to neutralize the effect of vanadium and other contaminants contained in the hydrocarbon, but problems are typically encountered in terms of emulsion stability, flocculation and corrosion, and such efforts require additives and treatments which are very expensive. One such effort involves the mixture of liquid magnesium nitrate to the aqueous phase. However, the nitrate encourages bacteria growth in the emulsion which leads to instability, and is also an expensive additive.

The need remains for an emulsion and process for preparing same wherein the adverse affect of vanadium, sulfur and other hydrocarbon contaminants are counteracted without adversely impacting upon emulsion stability and without drastically increasing the cost of preparation of same.

It is therefore the primary object of the present invention to provide a process for preparing a hydrocarbon in water emulsion which includes an additive for controlling vanadium-induced high temperature corrosion and emulsion flocculation.

It is a further object of the present invention to provide an emulsion and process for preparing same wherein the additive is used in relatively small amounts and, further, is itself a relatively inexpensive ingredient.

It is a still further object of the present invention to provide an emulsion and process for preparing same including an additive for counteracting vanadium, sulfur and other contaminants, which does not adversely affect, and in some cases enhances, emulsion stability.

Other objects and advantages of the present invention will appear hereinbelow.

SUMMARY OF THE INVENTION

In accordance with the present invention, the foregoing objects and advantages are readily attained.

According to the invention, a process is provided for preparing a hydrocarbon in water emulsion, which process comprises the steps of: providing a hydrocarbon phase containing a contaminant selected from the group consisting of vanadium, sulfur, and mixture thereof; mixing a solid additive with said hydrocarbon phase, said solid additive being selected from the group consisting of calcium compounds, magnesium compounds and mixtures thereof so as to provide a hydrocarbon suspension including said solid additive; and forming an emulsion from said hydrocarbon suspension and an aqueous phase including a surfactant so as to form a combustible hydrocarbon in water emulsion having said solid additive suspended in said hydrocarbon phase.

In further accordance with the present invention, a combustible hydrocarbon in water emulsion is provided, which emulsion comprises a hydrocarbon phase containing a contaminant selected from the group consisting of vanadium, sulfur and mixtures thereof, a water phase, a surfactant, and a solid additive suspended in the hydrocarbon phase, said solid additive being selected from the group consisting of calcium compounds, magnesium compounds and mixtures thereof.

The preferred solid additive in accordance with the present invention is selected from the group consisting of calcium salts, calcium oxide, magnesium salts, magnesium oxide and mixtures thereof, and is most preferably calcium carbonate.

BRIEF DESCRIPTION OF THE DRAWINGS

A detailed description of preferred embodiments of the invention follows, with reference to the attached drawings, wherein.

DETAILED DESCRIPTION OF THE PREFERRED EMBODIMENTS

Figure 1:
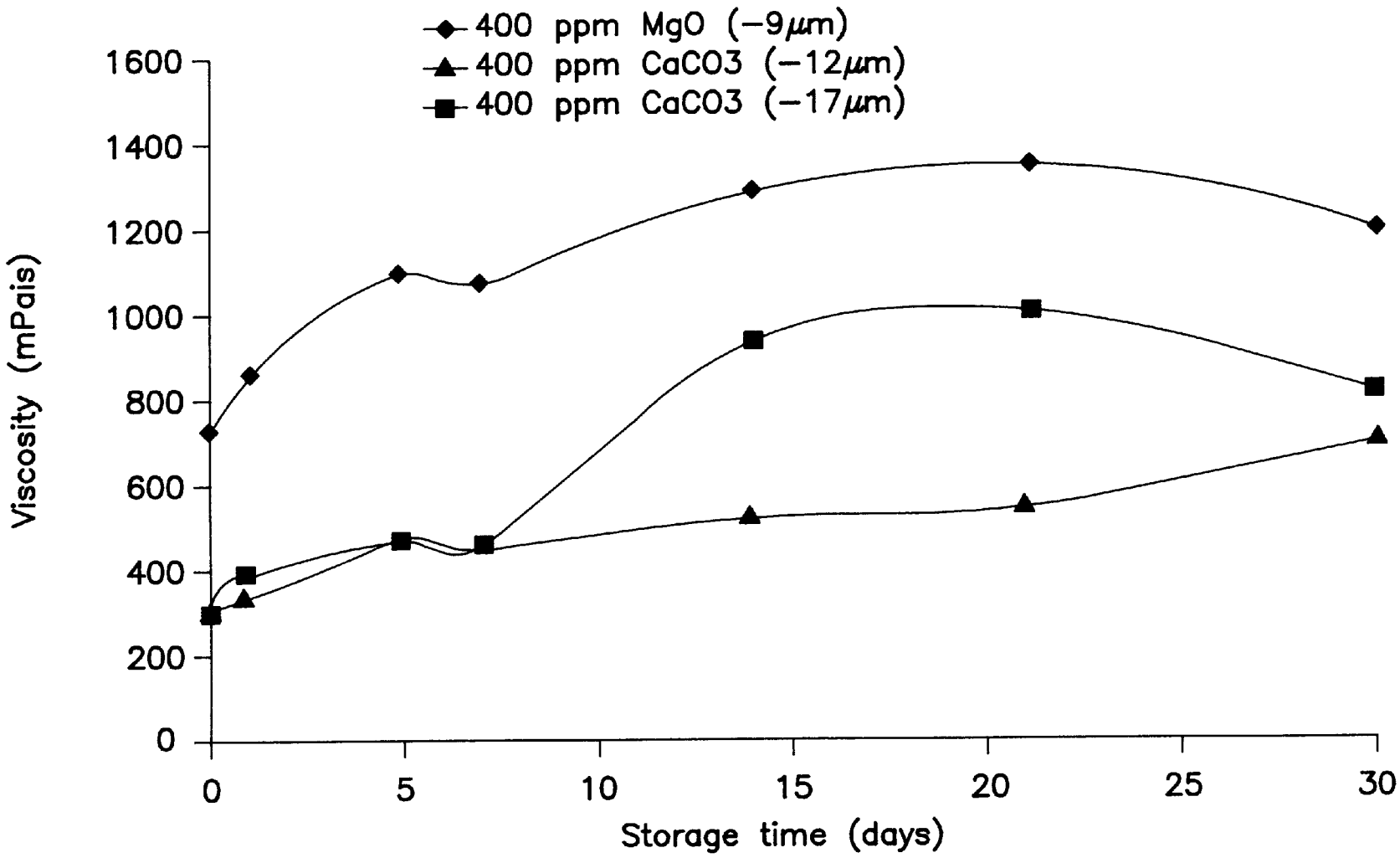
FIG. 1 illustrates viscosity as a function of time for emulsions prepared as described in Example 1 using 400 ppm of magnesium oxide and calcium carbonate at different solid particle sizes.

The invention relates to a hydrocarbon in water emulsion and process for preparing same, and particularly to a viscous hydrocarbon or bitumen in water emulsion, wherein the bitumen contains vanadium and/or sulfur contaminants, and is further provided with a solid additive suspended therein which effectively reduces adverse affects of the vanadium and sulfur and the like during combustion, and which further serves to provide an emulsion having excellent stability at a reasonable cost.

The hydrocarbon phase of the emulsion and process of the present invention may suitably be any hydrocarbon, especially viscous hydrocarbons, from which it is desirable to form emulsions in water so as to enhance the transportability thereof. Emulsions of viscous hydrocarbon in water are useful as a combustible fuel.

Heavy hydrocarbons typically used in preparation of such combustible emulsions include a number of other constituents including vanadium, sulfur and the like which are considered contaminants and which can cause undesirable occurrences.

For example, at high temperatures such as combustion temperatures and the like, vanadium can induce corrosion which obviously is undesirable. Furthermore, emulsions of heavy hydrocarbon in water have a tendency toward flocculation which can lead to increased viscosity of the emulsion, and/or breaking of the emulsion.

In accordance with the present invention, it has been found that certain solid additives can be added to the hydrocarbon phase during preparation of the emulsion so as to both reduce the tendency toward flocculation and inhibit undesirable vanadium-induced high temperature corrosion. These solid additives, which are further discussed below, advantageously improve the characteristics of the emulsion and furthermore are less expensive than conventional treatments.

The hydrocarbon phase is preferably a viscous hydrocarbon having an API gravity of less than or equal to about 16 and a viscosity at 120° F. of greater than or equal to about 100 cp. A specific example of a suitable hydrocarbon for use in accordance with the present invention is Cerro Negro bitumen, which may typically have the following composition.

| TYPICAL CERRO NEGRO BITUMEN | |
|---|---|
| Gravity API 60° C. | 8.1 |
| Saturates % (wt.) | 29.4 |
| Aromatics % | 35.6 |
| Resins % | 18.9 |
| Asphaltenes % | 16.1 |
| Acidity (mg KOH/g) | 3.02 |
| Carbon % | 80.3 |
| Hydrogen % | 9.9 |
| Nitrogen (ppm) | 6188 |
| Sulfur % | 3.7 |
| Vanadium (ppm) | 367.4 |
| Nickel (ppm) | 95.5 |
| Sodium (ppm) | 11.8 |
| Conradson Carbon % | 17.2 |
| Water % | 0.1 |

Typically, the hydrocarbon contains vanadium in amounts between about 340 ppm and about 400 ppm, and contains sulfur, for example as sulfides, in amounts between about 3.5% wt. and about 3.9% wt.

The water or aqueous phase of the emulsion may suitably be water from any convenient source, and preferably includes a surfactant for stabilizing the desired emulsion. Suitable surfactants include non-ionic surfactants selected from the group consisting of alkyl phenol ethoxylated; ethoxylated alcohol; mixtures of ethoxylated alcohol, natural surfactant and amines; and mixtures thereof.

In accordance with the present invention, it has been found that the mixing of a solid additive with the hydrocarbon phase, wherein the solid additive is mixed in a specific ratio to the hydrocarbon phase, and is present at desired particle sizes or diameters, serves to greatly enhance the stability of the emulsion while counteracting tendency of vanadium to cause undesirable corrosion and the like. Solid additives in accordance with the present invention are preferably oil insoluble, and may include salts or oxides of calcium or magnesium, preferably calcium carbonate and/or magnesium oxide, and most preferably calcium carbonate.

In accordance with the present invention, the solid additive is preferably provided having an average particle size less than or equal to about the mean droplet size of the hydrocarbon phase in the final emulsion such that the solid particles remain suspended within hydrocarbon droplets as desired. In this regard, the solid additive of the present invention preferably has an average particle size less than a mean volume diameter ($D_{(4,3)}$) of the hydrocarbon, wherein the mean volume diameter is defined as follows:

$$D_{(4,3)}=(\Sigma di^4/vi)/(\Sigma di^3/vi),$$

wherein di is the mean diameter of band "i" of a histogram of the emulsion, and vi is the accumulated volume of droplets in that particular band. The solid additive in accordance with the present invention is preferably provided having an average particle size of less than or equal to about 30 microns, most preferably less than or equal to about 15 microns.

The solid additive is preferably also mixed with hydrocarbon in accordance with the present invention in amounts which are less than or equal to about 10% wt. of the hydrocarbon, so as to further reduce the possibility for sedimentation of the solid additive. In this regard, it has been found that solid additive may suitably be mixed with the hydrocarbon according to the following relation $$\Phi_S/(\Phi_H+\Phi_S)\leq K,$$

wherein $\Phi_S$ is the volume fraction of the solid additive, $\Phi_H$ is the volume fraction of the hydrocarbon, and K is 0.1.

In order to insure the internal dispersion of solid additive through the hydrocarbon or bitumen phase, the bitumen may preferably be heated to a temperature sufficient to allow substantially homogeneous mixture. For example, Cerro Negro bitumen is preferably heated to a temperature of about 60° C. prior to mixing with the solid additive.

The emulsion of the present invention may preferably be prepared according to a process wherein the viscous hydrocarbon phase having vanadium and/or sulfur contaminant is provided. The desired solid additive in accordance with the present invention is mixed with the hydrocarbon phase, preferably heated as discussed above, so as to allow the internal dispersion of the solid within the hydrocarbon. This suspension of solid particles in hydrocarbon is then used to form a hydrocarbon in water emulsion by mixing with an aqueous phase including surfactant as discussed above, and subjecting the mixture to sufficient mixing energy so as to provide an oil-in-water emulsion preferably having an average droplet size of the hydrocarbon phase of between about 1 $\mu$m and about 20 $\mu$m, and having a ratio by volume of hydrocarbon/water of between about 85/15 and about 70/30. Most preferably, in accordance with the present invention, the emulsion may be formed by mixing the hydrocarbon/solid suspension with a portion of the aqueous phase so as to provide an 85/15 emulsion, and subsequently diluting the emulsion to a desired 70/30 ratio.

As set forth above, the surfactant to be used in the aqueous phase may suitably be a non-ionic surfactant such as alkyl phenol ethoxylated, ethoxylated alcohol, or a mixture of ethoxylated alcohol with natural surfactants from the bitumen, and activated with amines. The amount of surfactant to be used is based upon the total amount of bitumen, and is preferably provided in an amount of between about 1500 ppm and about 3000 ppm wt. with respect to the bitumen. The following examples further demonstrate the advantageous nature of emulsions prepared in accordance with the present invention, and further as compared to a conventional emulsion containing a liquid magnesium nitrate additive added to the aqueous phase.

EXAMPLE 1

This example demonstrates the importance of particle size of the solid additive in accordance with the present invention.

Three emulsions were prepared using Cerro Negro bitumen having the following composition.

| | |
|---|---|
| Gravity API 60° C. | 8.1 |
| Saturates % (wt.) | 29.4 |
| Aromatics % | 35.6 |
| Resins % | 18.9 |
| Asphaltenes % | 16.1 |
| Acidity (mg KOH/g) | 3.02 |
| Carbon % | 80.3 |
| Hydrogen % | 9.9 |
| Nitrogen (ppm) | 6188 |
| Sulfur % | 3.7 |
| Vanadium (ppm) | 367.4 |
| Nickel (ppm) | 95.5 |
| Sodium (ppm) | 11.8 |
| Conradson Carbon % | 17.2 |
| Water % | 0.1 |

These emulsions were prepared by mixing 400 ppm wt. of a solid additive with the bitumen, and subsequently preparing an 85/15 emulsion using an aqueous solution containing 3000 ppm of Intan 100 surfactant. These emulsions were then diluted to 70/30 emulsions having a mean volume diameter ($D_{(4,3)}$) of 9 $\mu$m, 12 $\mu$m and 17 $\mu$m. These emulsions were stored, and FIG. 1 illustrates the viscosity for each emulsion over time. As shown, better results are obtained using the calcium carbonate additive in viscosity for each emulsion over time. As shown, better results are obtained using the calcium carbonate additive in accordance with the present invention. Furthermore, the best results are obtained using 400 ppm calcium carbonate having an average particle size of 12 microns, particularly as compared to the emulsion prepared using the same amount of calcium carbonate having an average particle diameter of 17 microns.

EXAMPLE 2

This example demonstrates the affect upon emulsion stability of the amount of solid additive used in preparation of the emulsion in accordance with the present invention.

Four emulsions were prepared following the same procedure set forth above in Example 1, and using varying amounts of solid additive in the form of calcium carbonate. These emulsions were then stored, and FIG. 2 illustrates the viscosity of these emulsions over storage time.

Figure 2:
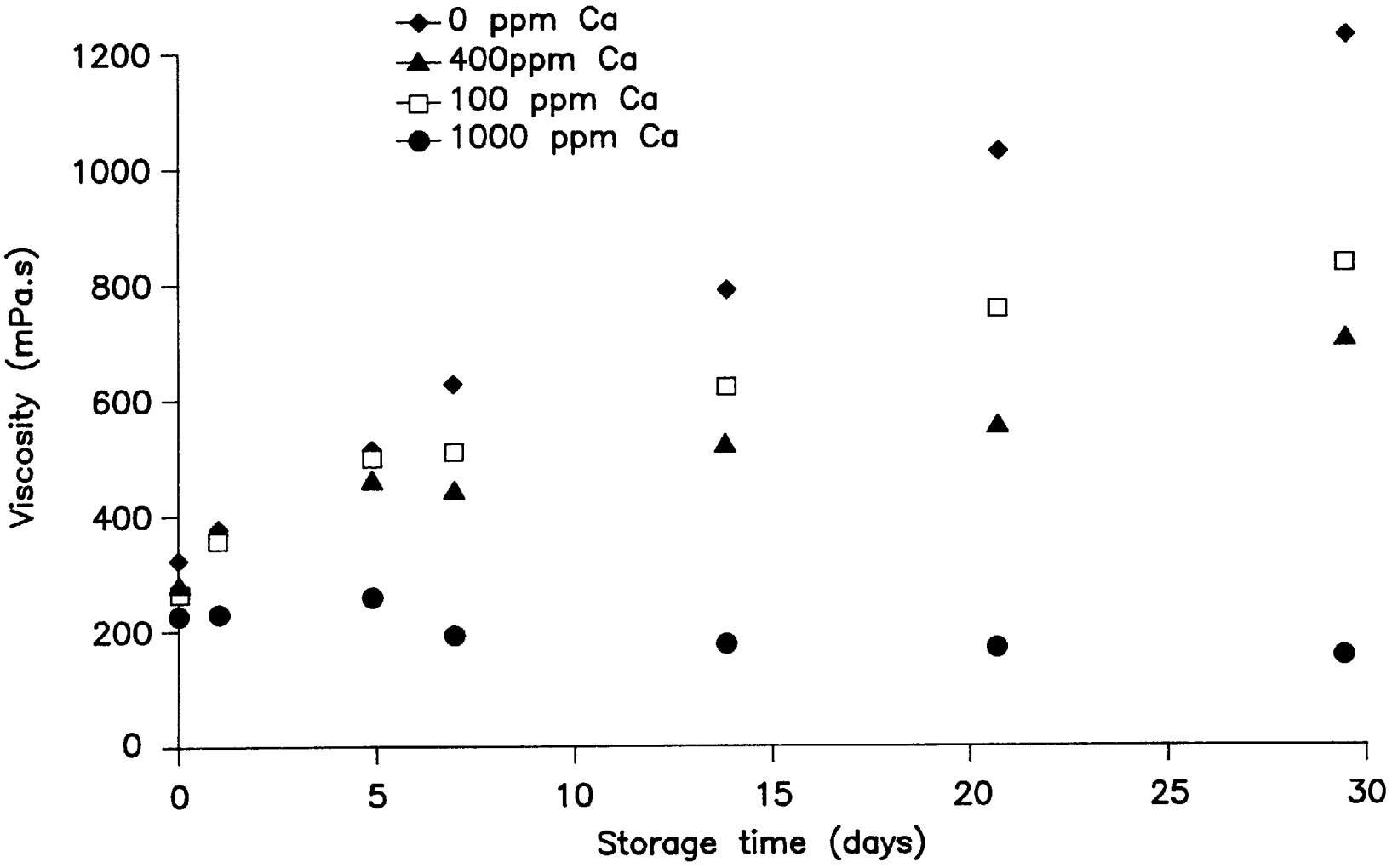
FIG. 2 illustrates viscosity as a function of storage time for emulsions prepared as described in Example 2 using different amounts of calcium carbonate.
Figure 3:
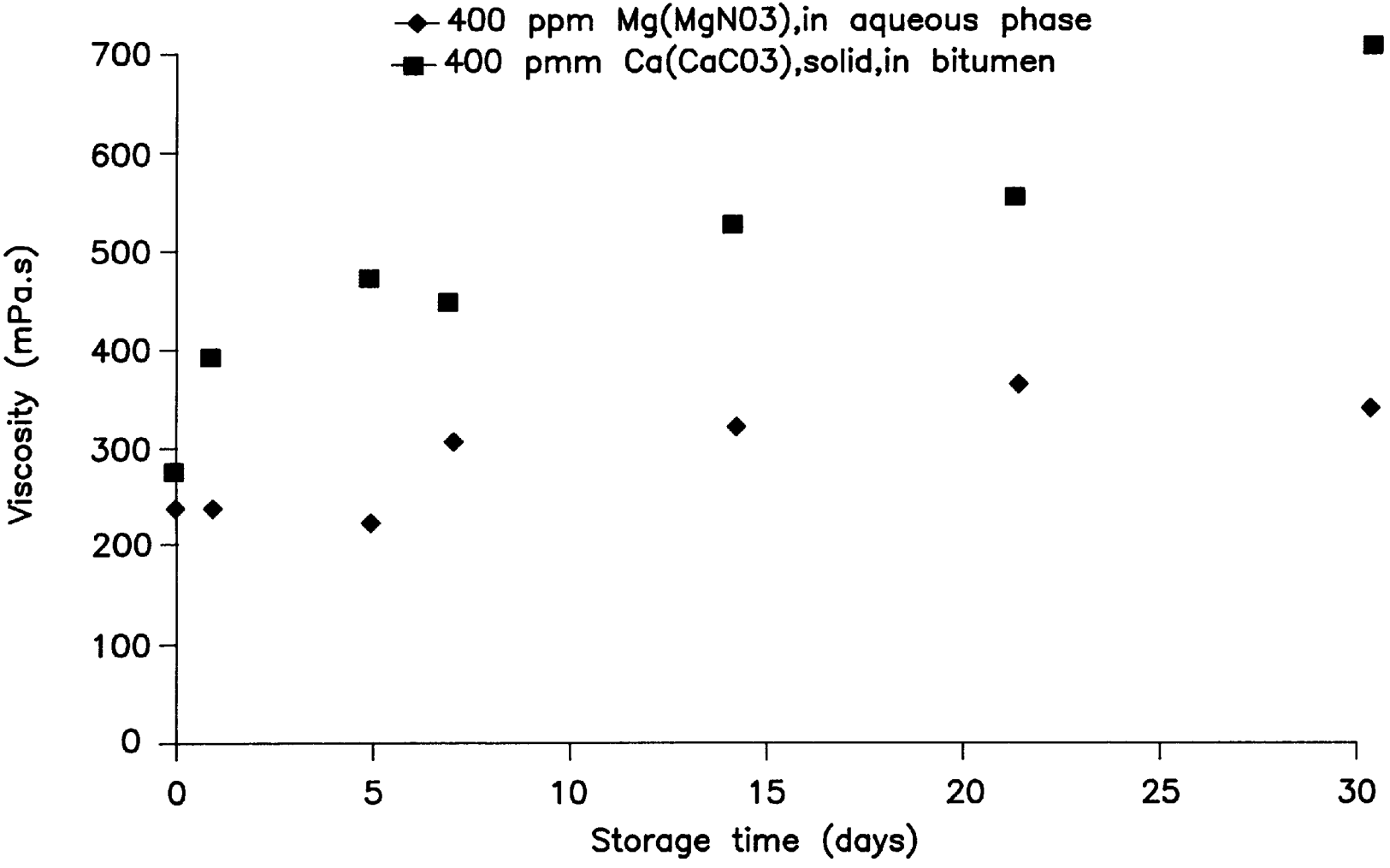
FIG. 3 illustrates viscosity as a function of time for an emulsion prepared using solid calcium carbonate in accordance with the present invention as compared to an emulsion prepared using liquid magnesium nitrate in accordance with the prior art.

Referring to FIG. 2, it is readily apparent that the larger amounts of solid additive provided an emulsion which was more stable. This is shown in FIG. 2 by the substantially constant viscosity of the emulsion over storage time.

EXAMPLE 3

This example demonstrates that emulsions prepared using solid calcium carbonate in accordance with the present invention are comparable in stability to emulsions prepared using liquid magnesium nitrate, added to the aqueous phase, in accordance with the prior art.

A first emulsion was prepared in accordance with the process of the present invention, as described above in Example 1, and using 400 ppm of calcium carbonate solid additive added to the hydrocarbon phase. A second emulsion was prepared using 400 ppm magnesium nitrate as a liquid added to the aqueous phase. As shown in FIG. 2, both emulsions are substantially stable. However, the emulsion prepared in accordance with the process of the present invention uses less expensive ingredients, and has less tendency toward bacteria growth which can ultimately lead to instability of the emulsion.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for preparing a hydrocarbon in water emulsion, comprising the steps of:

providing a hydrocarbon phase containing a contaminant selected from the group consisting of vanadium, sulfur, and mixtures thereof;

mixing a solid additive with said hydrocarbon phase, said solid additive being selected from the group consisting of calcium compounds, magnesium compounds and mixtures thereof so as to provide a hydrocarbon suspension including said solid additive; and forming an emulsion from said hydrocarbon suspension and an aqueous phase including a surfactant so as to form a combustible hydrocarbon in water emulsion having said solid additive suspended in said hydrocarbon phase.

2. A process according to claim 1, wherein said hydrocarbon is a viscous hydrocarbon having an API gravity of less than or equal to about 16, and a viscosity at 122° F. of greater than or equal to about 100 cp.

3. A process according to claim 1, wherein said hydrocarbon contains vanadium in an amount between about 340 ppm and about 400 ppm wt., and contains sulfur in an amount between about 3.5% wt. and about 3.9% wt.

4. A process according to claim 1, wherein said hydrocarbon is Cerro Negro bitumen.

5. A process according to claim 1, wherein said solid additive is selected from the group consisting of calcium salts, calcium oxide, magnesium salts, magnesium oxide, and mixtures thereof.

6. A process according to claim 1, wherein said solid additive is selected from the group consisting of calcium carbonate, magnesium oxide, and mixtures thereof.

7. A process according to claim 1, wherein said solid additive is calcium carbonate.

8. A process according to claim 1, further comprising providing said solid additive having an average particle size of less than or equal to about a mean droplet size of said hydrocarbon phase in said emulsion.

9. A process according to claim 1, further comprising providing said solid additive having an average particle size which is less than a mean volume diameter $D_{(4,3)}$ of said hydrocarbon, which is defined as follows:

$$D_{(4,3)}=(\Sigma di^4/vi)/(\Sigma di^3/vi),$$

wherein di is mean diameter of band i of a histogram of said emulsion, and vi is accumulated volume of droplets in said band.

10. A process according to claim 1, further comprising providing said solid additive having an average particle size of less than or equal to about 30 $\mu$m.

11. A process according to claim 1, further comprising having said solid additive has an average particle size of less than or equal to about 15 $\mu$m.

12. A process according to claim 1, further comprising mixing said solid additive with said hydrocarbon in an amount less than or equal to about 10% wt. of said hydrocarbon.

13. A process according to claim 1, further comprising mixing said solid additive with said hydrocarbon according to the following:

$$\Phi_S/(\Phi_H+\Phi_S)\leqq K,$$

wherein $\Phi_S$ is volume fraction of said solid additive, $\Phi_H$ is volume fraction of said hydrocarbon, and K is 0.1.

14. A process according to claim 1, wherein said forming step comprises mixing said hydrocarbon suspension with said aqueous phase so as to provide an initial emulsion having a ratio by volume of hydrocarbon/water of about 85/15, and diluting said initial emulsion with additional water to provide a final emulsion having a ratio by volume of hydrocarbon/water of about 70/30.

15. A combustible hydrocarbon in water emulsion comprising a hydrocarbon phase containing a contaminant selected from the group consisting of vanadium, sulfur and mixtures thereof, a water phase, a surfactant, and a solid additive suspended in the hydrocarbon phase, said solid additive being selected from the group consisting of calcium compounds, magnesium compounds and mixtures thereof.

16. An emulsion according to claim 15, wherein said hydrocarbon phase is a viscous hydrocarbon having an API gravity of less than or equal to about 16, and a viscosity at 122° F. of greater than or equal to about 100 cp.

17. An emulsion according to claim 15, wherein said hydrocarbon contains said vanadium in an amount between about 340 ppm and about 400 ppm (wt.), and contains sulfur in an amount between about 3.5% and about 3.9% (wt.).

18. An emulsion according to claim 15, wherein said hydrocarbon is Cerro Negro bitumen.

19. An emulsion according to claim 15, wherein said solid additive is selected from the group consisting of calcium salts, calcium oxide, magnesium salts, magnesium oxide, and mixtures thereof.

20. An emulsion according to claim 15, wherein said solid additive is selected from the group consisting of calcium carbonate, magnesium oxide, and mixtures thereof.

21. An emulsion according to claim 15, wherein said solid additives is calcium carbonate.

22. A emulsion according to claim 15, wherein said solid additive has an average particle size of less than or equal to about a mean droplet size of said hydrocarbon phase in said emulsion.

23. An emulsion according to claim 15, wherein said solid additive has an average particle size which is less than a mean volume diameter $D_{(4,3)}$ of said hydrocarbon, which is defined as follows:

$$D_{(4,3)}=(\Sigma di^4/vi)/(\Sigma di^3/vi),$$

wherein di is mean diameter of band i of a histogram of said emulsion, and vi is accumulated volume of droplets in said band.

24. A emulsion according to claim 15, wherein said solid additive has an average particle size of less than or equal to about 30 $\mu$m.

25. An emulsion according to claim 15, wherein said solid additive has an average particle size of less than or equal to about 15 $\mu$m.

26. An emulsion according to claim 15, wherein said solid additive is present in said emulsion in an amount less than or equal to about 10% wt. of said hydrocarbon.

27. An emulsion according to claim 15, wherein said solid additive is present in said emulsion according to the following:

$$\Phi_S/(\Phi_H+\Phi_S)\leqq K,$$

wherein $\Phi_S$ is volume fraction of said solid additive, $\Phi_H$ is volume fraction of said hydrocarbon, and K is 0.1.

28. An emulsion according to claim 15, wherein said hydrocarbon phase and said water phase are present at a ratio by volume of hydrocarbon/water between about 70/30 and about 85/15.

29. An emulsion according to claim 15, wherein said hydrocarbon phase has an average droplet diameter of between about 1 $\mu$m and about 20 $\mu$m.

* * * * *